US010482807B2

(12) United States Patent
Wang et al.

(10) Patent No.: US 10,482,807 B2
(45) Date of Patent: Nov. 19, 2019

(54) INTERFACE DEVICES AND LIQUID CRYSTAL DEVICES WITH THE SAME

(71) Applicant: Shenzhen China Star Optoelectronics Technology Co., Ltd., Shenzhen, Guangdong (CN)

(72) Inventors: Zhao Wang, Guangdong (CN); Yu-yeh Chen, Guangdong (CN); Yin-hung Chen, Guangdong (CN); Yu Wu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 236 days.

(21) Appl. No.: 15/129,922

(22) PCT Filed: Jul. 19, 2016

(86) PCT No.: PCT/CN2016/090513
§ 371 (c)(1),
(2) Date: Sep. 28, 2016

(87) PCT Pub. No.: WO2017/206289
PCT Pub. Date: Dec. 7, 2017

(65) Prior Publication Data

US 2018/0218666 A1 Aug. 2, 2018

(30) Foreign Application Priority Data

May 31, 2016 (CN) ..... 2016 1 0377836

(51) Int. Cl.
*G09G 3/20* (2006.01)
*G09G 3/36* (2006.01)
*G09G 5/00* (2006.01)

(52) U.S. Cl.
CPC ..... *G09G 3/2096* (2013.01); *G09G 3/3648* (2013.01); *G09G 5/006* (2013.01); *G09G 2370/08* (2013.01); *G09G 2370/14* (2013.01)

(58) Field of Classification Search
CPC ... G09F 3/20; G09G 3/36; G09G 5/00; G09G 3/2096; G09G 3/3648; G09G 2370/08; G09G 2370/14; G09G 5/006
See application file for complete search history.

(56) References Cited

U.S. PATENT DOCUMENTS

2004/0032383 A1* 2/2004 Chuang ..... G02F 1/1391 345/87
2004/0125068 A1* 7/2004 Lee ..... G09G 5/003 345/99

(Continued)

FOREIGN PATENT DOCUMENTS

CN 1512474 A 7/2004
CN 101266762 A 9/2008

(Continued)

*Primary Examiner* — Antonio Xavier
(74) *Attorney, Agent, or Firm* — Andrew C. Cheng

(57) ABSTRACT

The present disclosure relates to an interface device for high resolution liquid crystal device (LCD). The interface device includes a first connector configured to receive low voltage differential signals (LVDS) provided for a left-half active area of the LCD, a second connector configured to receive the LVDS provided for a right-half active area of the LCD, and a third connector configured to receive operational voltage signals and control signals provided for the LCD. The present disclosure also relates to a LCD with the above interface device. With such configuration, the data signals and the control signals are not mixed to enhance the signal quality, and the display performance of the LCD may not be affected.

7 Claims, 5 Drawing Sheets

(56) References Cited

U.S. PATENT DOCUMENTS

| | | | | |
|---|---|---|---|---|
| 2006/0256099 | A1* | 11/2006 | Tashiro | G09G 3/2092 345/204 |
| 2007/0117415 | A1* | 5/2007 | Shikina | G02F 1/13338 439/55 |
| 2008/0225036 | A1* | 9/2008 | Song | G09G 3/3611 345/213 |
| 2008/0231586 | A1* | 9/2008 | Wang | G09G 3/3611 345/99 |
| 2008/0239229 | A1* | 10/2008 | Park | G09G 3/3611 349/152 |
| 2008/0278428 | A1* | 11/2008 | Song | G09G 3/3696 345/98 |
| 2010/0014222 | A1* | 1/2010 | Hsu | G09G 3/34 361/679.01 |
| 2010/0220079 | A1* | 9/2010 | Bang | G09G 3/3648 345/204 |
| 2011/0122163 | A1* | 5/2011 | Suzuki | G09G 3/3648 345/690 |
| 2011/0221760 | A1* | 9/2011 | Irie | G09G 3/3648 345/589 |
| 2014/0118372 | A1* | 5/2014 | Hung | G09G 3/2096 345/532 |

FOREIGN PATENT DOCUMENTS

| | | | |
|---|---|---|---|
| CN | 101295476 | A | 10/2008 |
| CN | 101388182 | A | 3/2009 |
| CN | 101393732 | A | 3/2009 |
| CN | 101447156 | A | 6/2009 |
| CN | 102819410 | A | 12/2012 |
| CN | 102930845 | A | 2/2013 |
| CN | 103971651 | A | 8/2014 |
| KR | 2002-0000448 | A | 1/2002 |

* cited by examiner

INTERFACE DEVICES AND LIQUID CRYSTAL DEVICES WITH THE SAME

BACKGROUND OF THE INVENTION

1. Field of the Invention

The present disclosure relates to interface manufacturing technology, and more particularly to an interface device and a liquid crystal device (LCD) with the same.

2. Discussion of the Related Art

With the evolution of optical and semiconductor technology, flat panel display (FPD) has been greatly developed. Among the FPDs, the LCDs have been adopted in various applications due to the attributes, such as high space utilization rate, low power consumption, no radiation, and low electromagnetic interference.

With respect to the liquid crystal display technology, high-resolution LCDs, such as 8K or 4K, are now available. Among current high resolution LCDs, the interface devices are defined according to the actual needs of manufacturers. However, data signals and control signals may be mixed among the various interface devices, such that the signal quality may be affected, and so does the display performance of the LCDs.

SUMMARY

To overcome the above problem, the present disclosure relates to an interface device and the LCD with the same to prevent the signals from being mixed so as to enhance the signal quality.

In one aspect, an interface device for high resolution liquid crystal device (LCD) includes: a first connector configured to receive low voltage differential signals (LVDS) provided for a left-half active area of the LCD, a second connector configured to receive the LVDS provided for a right-half active area of the LCD, and a third connector configured to receive operational voltage signals and control signals provided for the LCD.

Wherein the left-half active area includes N number of left active areas along a direction from left to right in sequence, the first connector includes N number of left-positive-negative-pole-pin pairs, each of the left-positive-negative-pole-pin pairs includes a left-positive-pole-pin and a left-negative-pole-pin, each of the left-positive-pole-pins is configured to receive the positive LVDS provided for the corresponding left active area, and each of the left-negative-pole-pins is configured to receive the negative LVDS provided for the corresponding left active area.

Wherein the first connector further includes grounding pins configured before the N number of the left-positive-negative-pole-pin pairs, the grounding pins configured after the N number of the left-positive-negative-pole-pin pairs, and grounding pins configured between two adjacent left-positive-negative-pole-pin pairs.

Wherein the first connector further includes at least one no-load (NC) pin configured before the grounding pins, wherein the grounding pins are arranged before the N number of the left-positive-negative-pole-pin pairs.

Wherein the right-half active area includes N number of right active areas along a direction from left to right in sequence, the second connector includes N number of right-positive-negative-pole-pin pairs, each of the right-positive-negative-pole-pin pairs includes a right-positive-pole-pin and a right-negative-pole-pin, each of the right-positive-pole-pins is configured to receive the positive LVDS provided for the corresponding right active area, and each of the right-negative-pole-pins is configured to receive the negative LVDS provided for the corresponding right active area.

Wherein the second connector further includes the grounding pins configured before the N number of the right-positive-negative-pole-pin pairs, the grounding pins configured after the N number of the right-positive-negative-pole-pin pairs, and grounding pins configured between two adjacent right-positive-negative-pole-pin pairs.

Wherein the second connector further includes at least one NC pin configured before the grounding pins, wherein the grounding pins are arranged before the N number of the right-positive-negative-pole-pin pairs.

Wherein the third connector includes a plurality of voltage pins and a plurality of signal control pins arranged in sequence, each of the voltage pins is configured to receive the operational voltage signals for the LCD, and each of the signal control pins is configured to receive the control signals for the LCD.

Wherein the third connector further includes at least one NC pin and at least one grounding pin arranged between the voltage pins and the signal control pins in sequence.

In another aspect, the LCD includes the above interface device.

In view of the above, regarding the interface device, the data signals and the control signals are prevented from being mixed. In this way, the received signal quality may be enhanced, and the display performance of the LCD may not be affected.

DETAILED DESCRIPTION OF THE EMBODIMENTS

Figure 1:
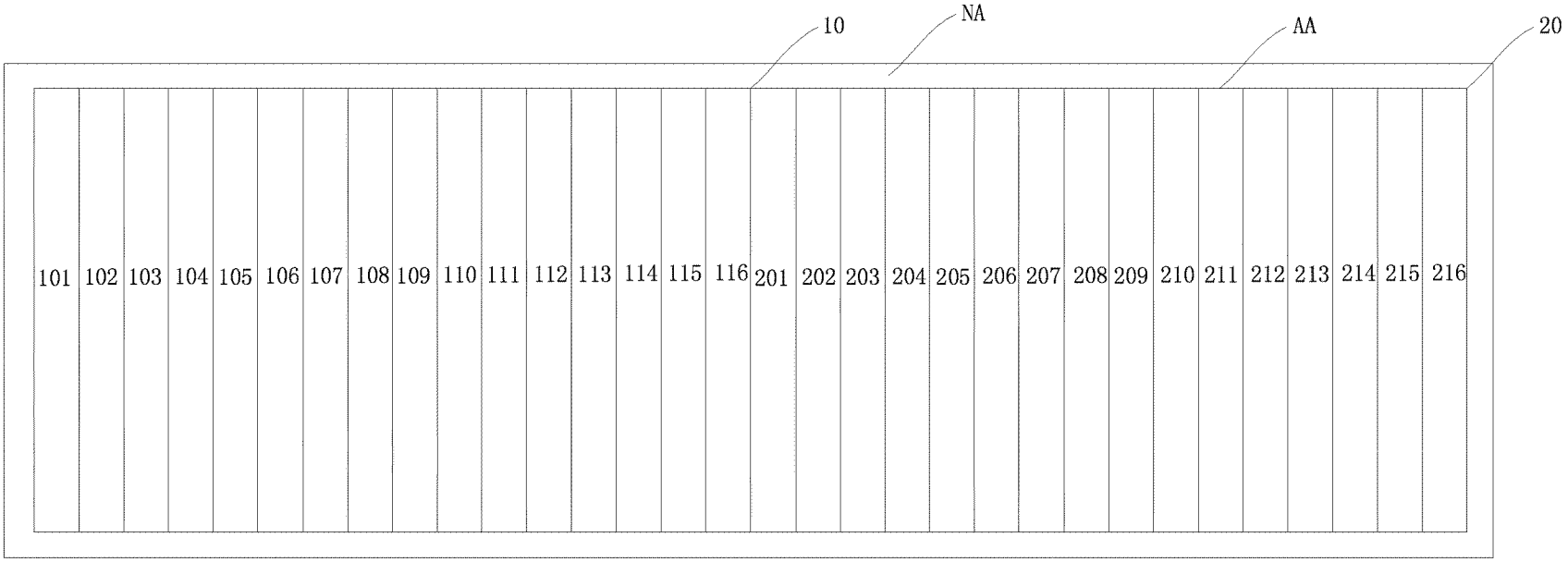
FIG. 1 is a schematic view showing the division of the display area of the LCD in accordance with one embodiment.

Various example embodiments will now be described more fully with reference to the accompanying drawings in which some example embodiments are shown. In the drawings, the thicknesses of layers and regions may be exaggerated for clarity. In the following description, in order to avoid the known structure and/or function unnecessary detailed description of the concept of the invention result in confusion, well-known structures may be omitted and/or functions described in unnecessary detail. The same reference numerals in the drawings refer to like elements throughout.

It should be understood that, although the possible use of the terms first, second, etc. are used to describe various components, but the components are not limited by these terms. These terms are only used to distinguish one element from another. For example, without departing from the scope of example embodiments, the first component may be named as a second component, similarly, the second component may be named as the first member.

FIG. 1 is a schematic view showing the division of the display area of the LCD in accordance with one embodiment.

Referring to FIG. 1, the LCD includes an active area (AA) and a non-active area (NA) surrounding the active area (AA).

In one embodiment, the active area (AA) is divided into two portions along a direction from left to right, and dimensions of the two portions are the same, however, the present disclosure is not limited to such division. In another example, the active area (AA) is divided into two portions along the direction from top to down, and the dimensions of the two portions are the same.

The left portion is defined as a left-half active area 10, and the right portion is defined as a right-half active area 20.

In the embodiment, the left-half active area 10 is divided into N number of left active areas along the direction from left to right in sequence, and the right-half active area 20 is divided into N number of right active area along the direction from right to left, however, the present disclosure is not limited to such division. In an example, the left-half active area 10 is divided into N number of left active areas along the direction from top to down, and the right-half active area 20 is divided into N number of right active area along the direction from down to top.

In the embodiment, N equals to 16, but the present disclosure is not limited thereto. In an example, N may be a positive integer not smaller than one. As such, the 16 left active areas include a first-left active area 101, a second-left active area 102, a third-left active area 103, a fourth-left active area 104, a fifth-left active area 105, a sixth-left active area 106, a seventh-left active area 107, an eighth-left active area 108, a ninth-left active area 109, a tenth-left active area 110, an eleventh-left active area 111, a twelfth-left active area 112, a thirteenth-left active area 113, a fourteenth-left active area 114, a sixteenth-left active area 115, and a sixteenth-left active area 116. The 16 right active areas include a first-right active area 201, a second-right active area 202, a third-right active area 203, a fourth-right active area 204, a fifth-right active area 205, a sixth-right active area 206, a seventh-right active area 207, an eighth-right active area 208, a ninth-right active area 209, a tenth-right active area 210, an eleventh-right active area 211, a twelfth-right active area 212, a thirteenth-right active area 213, a fourteenth-right active area 214, a sixteenth-right active area 215, and a sixteenth-right active area 216.

Figure 2:
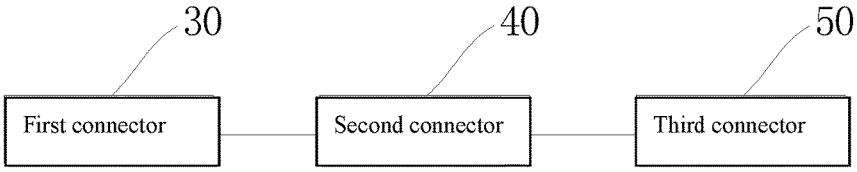
FIG. 2 is a schematic view of the interface device in accordance with one embodiment.
Figure 3:
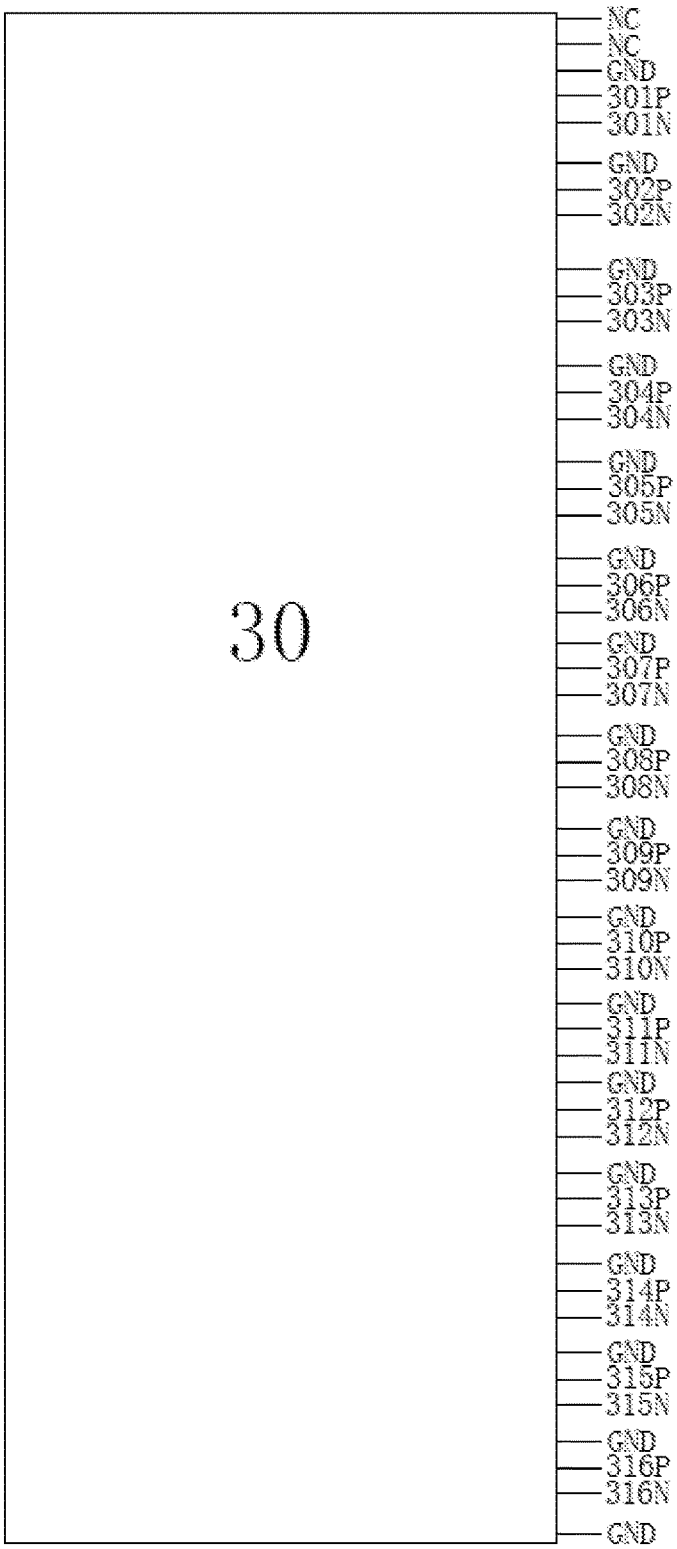
FIG. 3 is an example showing the configuration of the first connector in accordance with Table. 1 of the present disclosure.
Figure 4:
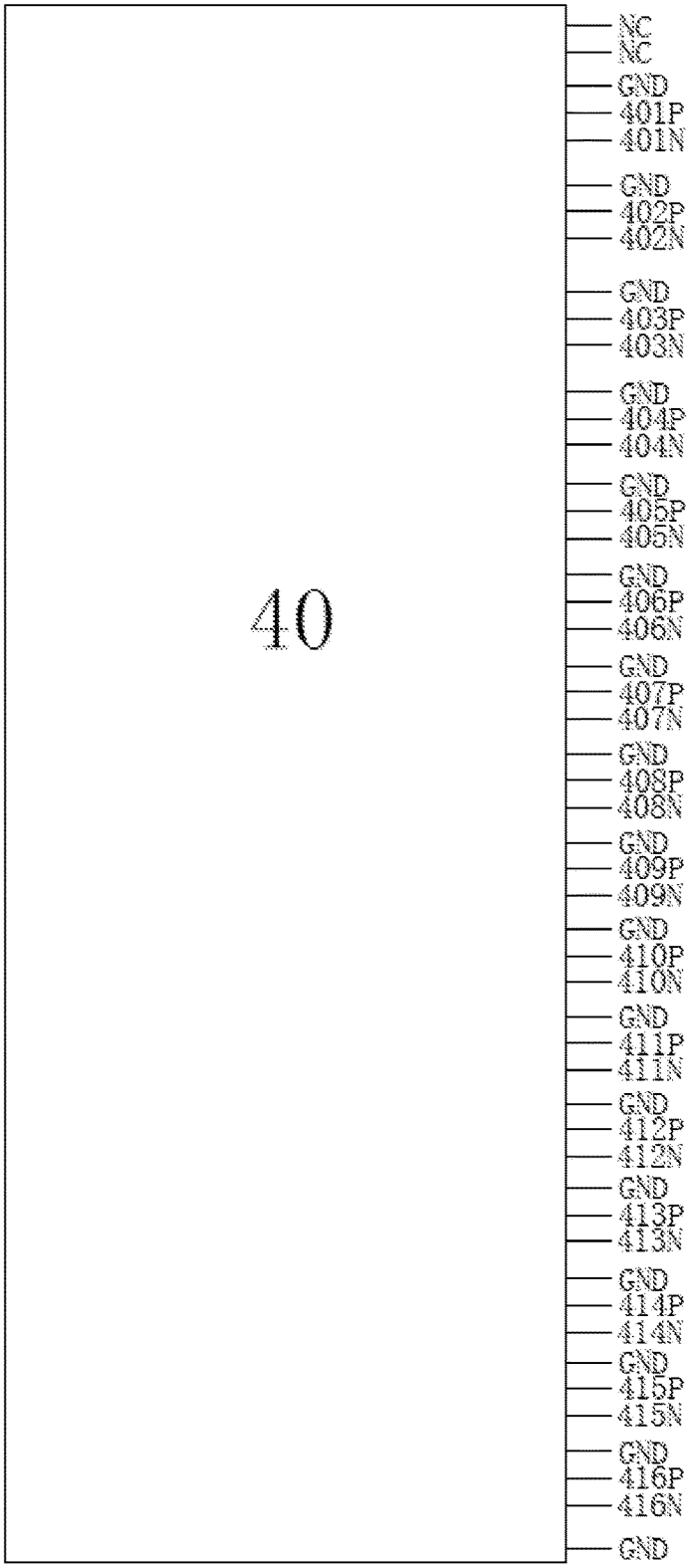
FIG. 4 is an example showing the configuration of the second connector in accordance with Table. 2 of the present disclosure.
Figure 5:
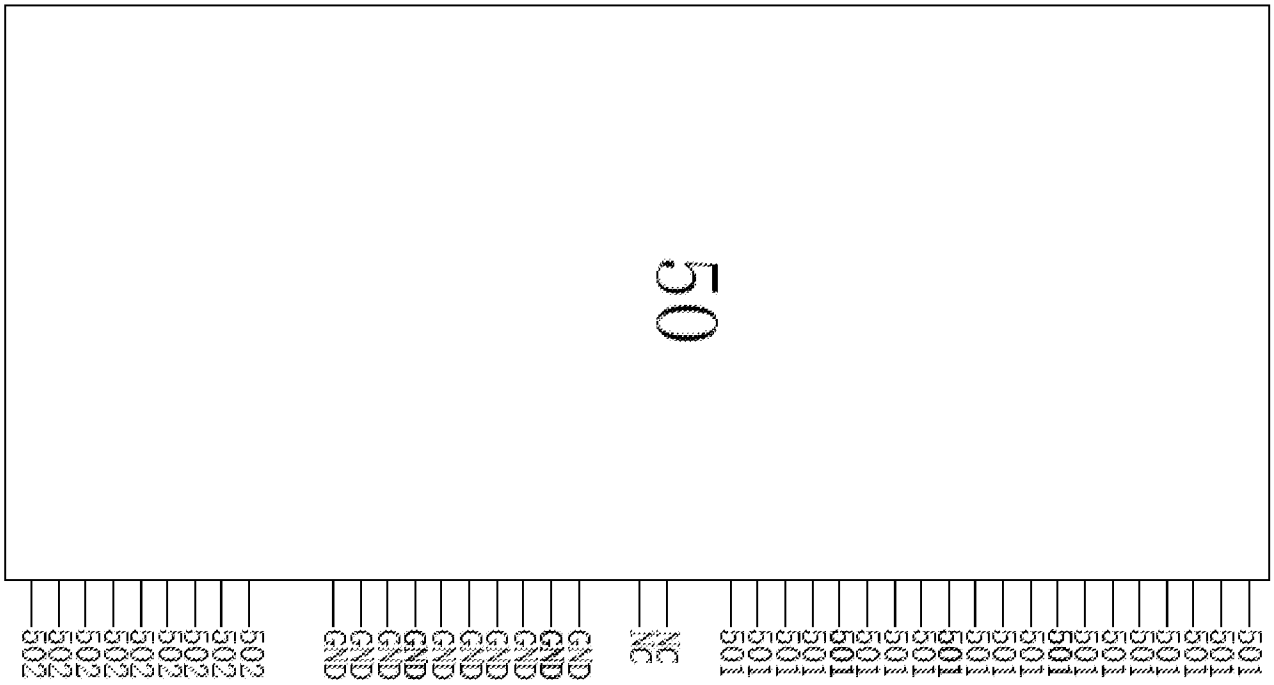
FIG. 5 is an example showing the configuration of the third connector in accordance with Table. 3 of the present disclosure.

FIG. 2 is a schematic view of the interface device in accordance with one embodiment.

Referring to FIGS. 1 and 2, the interface device includes a first connector 30, a second connector 40, and a third connector 50.

Specifically, the first connector 30 is configured to receive low voltage differential signals provided for the left-half active area 10 of the LCD, the second connector 40 is configured to receive the low voltage differential signals (LVDS) provided for the right-half active area 20 of the LCD, and the third connector 50 is configured to receive the operational voltage signals and control signals provided for the LCD.

The first connector 30 includes N number of left-positive-negative-pole-pin pairs. Each of the left-positive-negative-pole-pin pairs includes a left-positive-pole-pin and a left-negative-pole-pin. Each of the left-positive-pole-pins is configured to receive the positive LVDS provided for the corresponding left active area, and each of the left-negative-pole-pins is configured to receive the negative LVDS provided for the corresponding left active area.

In an example, the first connector 30 further includes grounding pins configured before the N number of the left-positive-negative-pole-pin pairs, the grounding pins configured after the N number of the left-positive-negative-pole-pin pairs, and grounding pins configured between two adjacent left-positive-negative-pole-pin pairs.

In an example, the first connector 30 further includes at least one no-load (NC) pin configured before the grounding pins, wherein the grounding pins are arranged before the N number of the left-positive-negative-pole-pin pairs.

In one example, N equals to 16. That is, the first connector 30 includes 16 left-positive-negative-pole-pin pairs, which include 16 left-positive-pole pin and 16 left-negative-pole pin. In addition, in one example, the NC pins configured before the grounding pins (GND) that are arranged before the N number of the left-positive-negative-pole-pin pairs.

Table. 1 shows the configuration of the first connector 30 in accordance with one embodiment.

TABLE 1

| Pin Name | Pin identifier |
|---|---|
| NC pin | NC |
| NC pin | NC |
| Grounding pin | GND |
| First left-positive pin | 301P |
| First left-negative pin | 301N |
| Grounding pin | GND |
| Second left-positive pin | 302P |
| Second left-negative pin | 302N |
| Grounding pin | GND |
| Third left-positive pin | 303P |
| Third left-negative pin | 303N |
| Grounding pin | GND |
| Fourth left-positive pin | 304P |
| Fourth left-negative pin | 304N |
| Grounding pin | GND |
| Fifth left-positive pin | 305P |
| Fifth left-negative pin | 305N |
| Grounding pin | GND |
| Sixth left-positive pin | 306P |
| Sixth left-negative pin | 306N |
| Grounding pin | GND |
| Seventh left-positive pin | 307P |
| Seventh left-negative pin | 307N |
| Grounding pin | GND |
| Eighth left-positive pin | 308P |
| Eighth left-negative pin | 308N |
| Grounding pin | GND |
| Ninth left-positive pin | 309P |
| Ninth left-negative pin | 309N |
| Grounding pin | GND |
| Tenth left-positive pin | 310P |
| Tenth left-negative pin | 310N |
| Grounding pin | GND |
| Eleventh left-positive pin | 311P |
| Eleventh left-negative pin | 311N |
| Grounding pin | GND |
| Twelveth left-positive pin | 312P |
| Twelveth left-negative pin | 312N |
| Grounding pin | GND |
| Thirteenth left-positive pin | 313P |
| Thirteenth left-negative pin | 313N |
| Grounding pin | GND |
| Fourteenth left-positive pin | 314P |
| Fourteenth left-negative pin | 314N |
| Grounding pin | GND |
| Fifteenth left-positive pin | 315P |
| Fifteenth left-negative pin | 315N |
| Grounding pin | GND |
| Sixteenth left-positive pin | 316P |
| Sixteenth left-negative pin | 316N |
| Grounding pin | GND |

The first left-positive-pole pin 301P through the sixteenth left-positive-pole pin 316P respectively corresponds to the positive LVDS provided to the first-left active area 101 through the sixteenth-left active area 116, and the first left-negative-pole pin 301N through the sixteenth left-negative-pole pin 316N respectively corresponds to the negative LVDS provided to the first-left active area 101 through the sixteenth-left active area 116.

The second connector 40 includes N number of right-positive-negative-pole-pin pairs. Each of the right-positive-negative-pole-pin pairs includes a right-positive-pole-pin and a right-negative-pole-pin. Each of the right-positive-pole-pins is configured to receive the positive LVDS provided for the corresponding right active area, and each of the right-negative-pole-pins is configured to receive the negative LVDS provided for the corresponding right active area.

In an example, the second connector 40 further includes the grounding pins configured before the N number of the right-positive-negative-pole-pin pairs, the grounding pins (GND) configured after the N number of the right-positive-negative-pole-pin pairs, and grounding pins (GND) configured between two adjacent right-positive-negative-pole-pin pairs.

In an example, the second connector 40 further includes at least one no-load (NC) pin configured before the grounding pins (GND), wherein the grounding pins (GND) are arranged before the N number of the right-positive-negative-pole-pin pairs.

In one example, N equals to 16. That is, the second connector 40 includes 16 right-positive-negative-pole-pin pairs, which include 16 right-positive-pole pin and 16 right-negative-pole pin. In addition, in one example, two NC pins are configured before the grounding pins (GND) arranged before the N number of the right-positive-negative-pole-pin pairs, but the present disclosure is not limited thereto.

Table. 2 shows the configuration of the second connector 40 in accordance with one embodiment.

TABLE 2

| Pin Name | Pin Identifier |
|---|---|
| NC pin | NC |
| NC pin | NC |
| Grounding pin | GND |
| First right-positive pin | 401P |
| First right-negative pin | 401N |
| Grounding pin | GND |
| Second right-positive pin | 402P |
| Second right-negative pin | 402N |
| Grounding pin | GND |
| Third right-positive pin | 403P |
| Third right-negative pin | 403N |
| Grounding pin | GND |
| Fourth right-positive pin | 404P |
| Fourth right-negative pin | 404N |
| Grounding pin | GND |
| Fifth right-positive pin | 405P |
| Fifth right-negative pin | 405N |
| Grounding pin | GND |
| Sixth right-positive pin | 406P |
| Sixth right-negative pin | 406N |
| Grounding pin | GND |
| Seventh right-positive pin | 407P |
| Seventh right-negative pin | 407N |
| Grounding pin | GND |
| Eighth right-positive pin | 408P |
| Eighth right-negative pin | 408N |
| Grounding pin | GND |
| Ninth right-positive pin | 409P |
| Ninth right-negative pin | 409N |
| Grounding pin | GND |

TABLE 2-continued

| Pin Name | Pin Identifier |
|---|---|
| Tenth right-positive pin | 410P |
| Tenth right-negative pin | 410N |
| Grounding pin | GND |
| Eleventh right-positive pin | 411P |
| Eleventh right-negative pin | 411N |
| Grounding pin | GND |
| Twelveth right-positive pin | 412P |
| Twelveth right-negative pin | 412N |
| Grounding pin | GND |
| Thirteenth right-positive pin | 413P |
| Thirteenth right-negative pin | 413N |
| Grounding pin | GND |
| Fourteenth right-positive pin | 414P |
| Fourteenth right-negative pin | 414N |
| Grounding pin | GND |
| Fifteenth right-positive pin | 415P |
| Fifteenth right-negative pin | 415N |
| Grounding pin | GND |
| Sixteenth right-positive pin | 416P |
| Sixteenth right-negative pin | 416N |
| Grounding pin | GND |

The first right-positive-pole pin 401P through the sixteenth right-positive-pole pin 416P respectively corresponds to the positive LVDS provided to the first-right active area 201 through the sixteenth-right active area 216, and the first right-negative-pole pin 401N through the sixteenth right-negative-pole pin 416N respectively corresponds to the negative LVDS provided to the first-right active area 201 through the sixteenth-right active area 26.

The third connector 50 includes a plurality of voltage pins and a plurality of signal control pins. Each of the voltage pins is configured to receive the operational voltage signals for the LCD, and each of the signal control pins is configured to receive the control signals for the LCD. In one embodiment, the first connector 30 includes 20 voltage pins and 9 signal control pins.

The third connector 50 further includes at least one NC pin and at least one grounding pin (GND) arranged between the voltage pins and the signal control pins in sequence. In one embodiment, the first connector 30 includes two NC pins and 10 grounding pin (GND).

Table. 3 shows the configuration of the third connector 50 in accordance with one embodiment.

TABLE 3

| Pin Name | Pin Identifier |
|---|---|
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| Voltage pin | 501 |
| NC pin | NC |
| NC pin | NC |

TABLE 3-continued

| Pin Name | Pin Identifier |
|---|---|
| Grounding pin | GND |
| Grounding pin | GND |
| Grounding pin | GND |
| Grounding pin | GND |
| Grounding pin | GND |
| Grounding pin | GND |
| Grounding pin | GND |
| Grounding pin | GND |
| Grounding pin | GND |
| Grounding pin | GND |
| Signal controlling pin | 502 |
| Signal controlling pin | 502 |
| Signal controlling pin | 502 |
| Signal controlling pin | 502 |
| Signal controlling pin | 502 |
| Signal controlling pin | 502 |
| Signal controlling pin | 502 |
| Signal controlling pin | 502 |
| Signal controlling pin | 502 |

Each of the voltage pins 501 is configured to receive the operational voltage signals provided for the LCD, and each of the signal control pins 502 is configured to receive the control signals provided for the LCD.

In view of the above, regarding the interface device, the data signals and the control signals are prevented from being mixed. In this way, the received signal quality may be enhanced, and the display performance of the LCD may not be affected.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An interface device for high resolution liquid crystal device (LCD), comprising:

a first connector configured to receive low voltage differential signals (LVDS) provided for a left-half active area of the LCD, a second connector configured to receive the LVDS provided for a right-half active area of the LCD, and a third connector configured to receive operational voltage signals and control signals provided for the LCD;

wherein the left-half active area comprises N number of left active areas along a direction from left to right in sequence, and each of the left active areas correspond to one left-positive-negative-pole-pin pair, the first connector comprises N number of left-positive-negative-pole-pin pairs, each of the left-positive-negative-pole-pin pairs comprises a first-left grounding pin, a left-positive-pole-pin and a left-negative-pole-pin, and the first-left grounding pin directly followed by the left-positive-pole-pin directly followed by the left-negative-pole-pin, each of the left-positive-pole-pins is configured to receive the positive LVDS provided for the corresponding left active area, and each of the left-negative-pole-pins is configured to receive the negative LVDS provided for the corresponding left active area; and wherein the first connector further comprises at least one no-load (NC) pin before the N number of left-positive-negative-pole-pin pairs, and a second-left grounding pin after the N number of left-positive-negative-pole-pin pairs.

2. The interface device as claimed in claim 1, wherein the right-half active area comprises N number of right active areas along a direction from left to right in sequence, and each of the right active areas correspond to one right-positive-negative-pole-pin pair, the second connector comprises N number of right-positive-negative-pole-pin pairs, each of the right-positive-negative-pole-pin pairs comprises a first-right grounding pin, a right-positive-pole-pin and a right-negative-pole-pin, and the first-right grounding pin directly followed by the right-positive-pole-pin directly followed by the right-negative-pole-pin, each of the right-positive-pole-pins is configured to receive the positive LVDS provided for the corresponding right active area, and each of the right-negative-pole-pins is configured to receive the negative LVDS provided for the corresponding right active area.

3. The interface device as claimed in claim 2, wherein the second connector further comprises at least one NC pin before the N number of the right-positive-negative-pole-pin pairs, and a second-right grounding pin after the N number of right-positive-negative-pole-pin pairs.

4. The interface device as claimed in claim 1, wherein the third connector comprises a plurality of voltage pins and a plurality of signal control pins arranged in sequence, each of the voltage pins is configured to receive the operational voltage signals for the LCD, and each of the signal control pins is configured to receive the control signals for the LCD.

5. The interface device as claimed in claim 3, wherein the third connector comprises a plurality of voltage pins and a plurality of signal control pins arranged in sequence, each of the voltage pins is configured to receive the operational voltage signals for the LCD, and each of the signal control pins is configured to receive the control signals for the LCD.

6. The interface device as claimed in claim 4, wherein the third connector further comprises at least one NC pin and at least one grounding pin arranged between the voltage pins and the signal control pins in sequence.

7. A liquid crystal device (LCD), comprising:

an interface device comprises a first connector configured to receive low voltage differential signals (LVDS) provided for a left-half active area of the LCD, a second connector configured to receive the LVDS provided for a right-half active area of the LCD, and a third connector configured to receive operational voltage signals and control signals provided for the LCD;

wherein the left-half active area comprises N number of left active areas along a direction from left to right in sequence, and each of the left active areas correspond to one left-positive-negative-pole-pin pair, the first connector comprises N number of left-positive-negative-pole-pin pairs, each of the left-positive-negative-pole-pin pairs comprises a first-left grounding pin, a left-positive-pole-pin and a left-negative-pole-pin, and the first-left grounding pin directly followed by the left-positive-pole-pin directly followed by the left-negative-pole-pin, each of the left-positive-pole-pins is configured to receive the positive LVDS provided for the corresponding left active area, and each of the left-negative-pole-pins is configured to receive the negative LVDS provided for the corresponding left active area;

wherein the first connector further comprises at least one no-load (NC) pin before the N number of left-positive-negative-pole-pin pairs, and a second-left grounding pin after the N number of left-positive-negative-pole-pin pairs; and wherein the right-half active area comprises N number of right active areas along a direction from left to right in sequence, and each of the right active areas correspond to one right-positive-negative-pole-pin pair, the second connector comprises N number of right-positive-negative-pole-pin pairs, each of the right-positive-negative-pole-pin pairs comprises a first-right grounding pin, a right-positive-pole-pin and a right-negative-pole-pin, and the first-right grounding pin directly followed by the right-positive-pole-pin directly followed by the right-negative-pole-pin, each of the right-positive-pole-pins is configured to receive the positive LVDS provided for the corresponding right active area, and each of the right-negative-pole-pins is configured to receive the negative LVDS provided for the corresponding right active area.

* * * * *